US012270162B1

(12) United States Patent
Chen

(10) Patent No.: US 12,270,162 B1
(45) Date of Patent: Apr. 8, 2025

(54) ROAD MILLING CUTTING DISC, ROAD MILLING DEVICE AND ROAD PLANING MACHINE

(71) Applicant: BROWN STONE TECHNOLOGY PTY LTD, Wa (AU)

(72) Inventor: Xiaojian Chen, Wa (AU)

(73) Assignee: BROWN STONE TECHNOLOGY PTY LTD, Wa (AU)

( * ) Notice: Subject to any disclaimer, the term of this patent is extended or adjusted under 35 U.S.C. 154(b) by 0 days.

(21) Appl. No.: 18/672,411

(22) Filed: May 23, 2024

Related U.S. Application Data

(63) Continuation of application No. PCT/CN2024/082586, filed on Mar. 20, 2024.

(30) Foreign Application Priority Data

Mar. 5, 2024 (CN) ..... 202420421988.8

(51) Int. Cl.
*E01C 23/088* (2006.01)

(52) U.S. Cl.
CPC ..... *E01C 23/088* (2013.01)

(58) Field of Classification Search
CPC ... E01C 23/088; E01C 23/0885; E01C 23/094
See application file for complete search history.

(56) References Cited

U.S. PATENT DOCUMENTS 3,539,014 A * 11/1970 Jonsson ..... E01H 5/094 37/219
4,458,949 A * 7/1984 Jury ..... E02D 29/1445 404/90
6,076,895 A * 6/2000 Ino ..... E01C 23/094 299/41.1

* cited by examiner

*Primary Examiner* — Carib A Oquendo
(74) *Attorney, Agent, or Firm* — WPAT, PC

(57) ABSTRACT

A road milling cutting disc includes a support body in a disc shape, the support body includes a circumferential surface and a bottom surface which are arranged sequentially in that order from top to bottom, the bottom surface is configured to be arranged facing toward a road surface, the circumferential surface surrounds the bottom surface and is connected to the bottom surface along an edge of the bottom surface, the bottom surface is provided with multiple first cutting teeth around a rotational axis of the support body, and the circumferential surface is provided with multiple second cutting teeth around the rotational axis of the support body. Problems of cutting and flattening protruding rocks on the road surface are solved.

14 Claims, 8 Drawing Sheets

ROAD MILLING CUTTING DISC, ROAD MILLING DEVICE AND ROAD PLANING MACHINE

CROSS-REFERENCE TO RELATED APPLICATIONS

This application is a continuation of International Patent Application No. PCT/CN2024/082586, filed Mar. 20, 2024, which claims the priority of Chinese Patent Application No. 2024204219888, filed Mar. 5, 2024, both of which are herein incorporated by reference in their entirety.

TECHNICAL FIELD

The disclosure relates to the field of road construction equipment and technologies, and more particularly to a road milling cutting disc, a road milling device, and a road planing machine.

BACKGROUND

There are often protruding rocks on a road surface of mining pits, as well as on a road surface of some construction sites. When vehicles travel on the road surface with the protruding rocks, the degree of bumpiness is high, which can easily lead to vehicle fatigue damage, accelerate tire wear, result in slow driving speeds, and low work efficiency, and to some extent, it can also cause physical harm to the drivers.

Therefore, there is an urgent need for a device that can break and flatten the protruding rocks on the road surface.

SUMMARY

In view of the above problems in the related art, the disclosure solves them at least to some extent. Therefore, the disclosure provides a road milling cutting disc, a road milling device, and a road planing machine, solving the problems of crushing and flattening protruding rocks on a road surface.

To achieve above purposes, the main technical solutions of the disclosure includes the following.

In a first aspect, the disclosure provides the road milling cutting disc, including a support body in a disc shape, the support body includes a circumferential surface and a bottom surface which are arranged sequentially in that order from top to bottom, the bottom surface is configured to be arranged facing toward the road surface, the circumferential surface surrounds the bottom surface and is connected to the bottom surface along an edge of the bottom surface, the bottom surface is provided with multiple first cutting teeth around a rotational axis of the support body, and the circumferential surface is provided with multiple second cutting teeth around the rotational axis of the support body.

In an embodiment, the support body defines a cavity therein.

In an embodiment, a top of the support body defines an opening connected to the cavity, and a position of the support body inside the cavity corresponding to the opening is provided with a rotating drive shaft installation position.

In an embodiment, the first cutting teeth are arranged in a circular manner around the rotational axis of the support body on the bottom surface, and the second cutting teeth are arranged in a circular manner around the rotational axis of the support body on the circumferential surface; or the first cutting teeth are arranged in a spiral manner around the rotational axis of the support body on the bottom surface, and the second cutting teeth are arranged in a spiral manner around the rotational axis of the support body on the circumferential surface.

In an embodiment, each of the first cutting teeth extends along a circular arrangement direction and is inclined downward, and each of the second cutting teeth extends along a circular arrangement direction and is inclined downward; or each of the first cutting teeth extends along a spiral arrangement direction and is inclined downward, and each of the second cutting teeth extends along a spiral arrangement direction and is inclined downward.

In an embodiment, the first cutting teeth are detachably connected to the support body and the second cutting teeth are detachably connected to the support body.

In a second aspect, the disclosure provides the road milling device, including an installation board and the road milling cutting disc which are sequentially arranged in that order from top to bottom, the top of the support body is rotatably installed on the installation board, a bottom surface of the installation board is connected to multiple cover boards, the cover boards are arranged adjacent to each other, and the cover boards are configured to be in contact with the road surface during a process of cutting the road surface by the road milling cutting disc.

In an embodiment, each cover board is connected to the installation board by springs.

In a third aspect, the disclosure provides the road planing machine, including a vehicle body and the road milling cutting disc, the road milling cutting disc is suspended on the vehicle body and configured to be in contact with and engaged with the road surface, and the vehicle body is configured to drive the cutting disc to work.

In an embodiment, the road planing machine further includes a rotating drive assembly. A frame of the vehicle body includes a front frame and a rear frame which are sequentially hinged from front to rear, the rear frame is supported on drive wheels, the front frame is supported on steering wheels, the rear frame is provided with an engine, an underside of the front frame is provided with a pull rod, a front end of the pull rod is connected to a front end of the front frame by a multi-dimensional universal joint, and a rear end of the pull rod is connected to the front frame by a first linear linkage rod and a second linear linkage rod which are at two sides of the front frame respectively. The rotating drive assembly and the road milling cutting disc are both installed to the pull rod, the road milling cutting disc is under the pull rod, the rotating drive assembly is in transmission connection with the road milling cutting disc, and the engine is in transmission connection with the drive wheels and the rotating drive assembly separately.

The disclosure has following beneficial effects.

The road milling cutting disc provided by the disclosure includes the support body in the disc shape. The first cutting teeth on the bottom surface of the support body may cut rocks in a horizontal direction, and the second cutting teeth on the circumferential surface may cut the rocks in a vertical direction, with high rock-breaking efficiency. After cutting the protruding rocks, crushed rocks are easy to be dispersed and distributed, and can form a smoother road surface, which is conducive to vehicle driving.

For the road milling device provided by the disclosure, when the road milling cutting disc is rotating to cut the rocks, debris splashed out can be blocked within the cover boards, avoiding damage caused by the debris splashed out.

The road planing machine provided by the disclosure includes the road milling cutting disc, which can effectively crush and flatten the protruding rocks on the road surface.

BRIEF DESCRIPTION OF DRAWINGS

The accompanying drawings are used to provide a further understanding of the disclosure and form a part of the specification. Together with specific embodiments of the disclosure, they are used to explain the disclosure and do not constitute a limitation of the disclosure.

Figure 1:
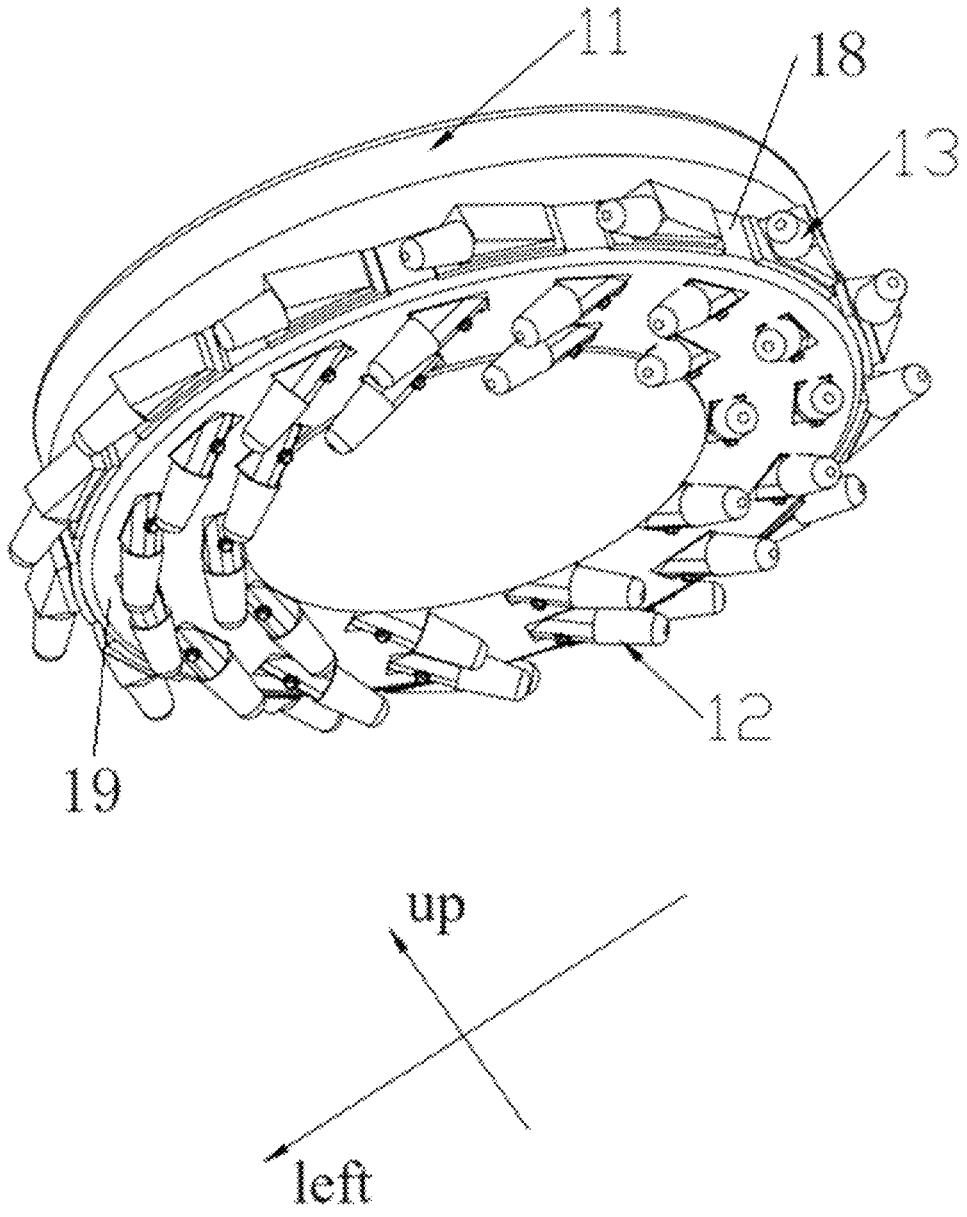
FIG. 1 illustrates a schematic three-dimensional structural diagram of a road milling cutting disc according to an embodiment 1 of the disclosure.

Description of reference numerals: 11: support body; 12: first cutting tooth; 13: second cutting tooth; 14: opening; 15: rotating drive shaft installation position; 16: first installation member; 17: first cutting tooth installation position; 18: circumferential surface; 19: bottom surface; 110: cavity; 111: flange; 112: spring; 171: first cutting tooth installation groove; 121: first installation component; 122: first cutting component; 2: installation board; 3: cover board; 4: front frame; 41: first lifting cylinder; 42: second lifting cylinder; 5: rear frame; 6: drive wheel; 7: steering wheel; 9: pull rod; 10: rotating drive assembly; 101: universal joint; 20: vehicle body; 21: engine; 22: multi-dimensional universal joint; 23: first linear linkage rod; 24: second linear linkage rod; 201: spoke; 202: cavity; 203: installation hole; 204: periphery cutting tooth; 205: web; 206: side cutting tooth; 207: bottom cutting tooth; 208: periphery surface; 209: cutting disc body; 301: transverse web; 302: gap; 303: large transverse cutting tooth; 304: small transverse cutting tooth; 305: cutting tooth disc periphery; 306: longitudinal web; 307: longitudinal cutting tooth; 308: cavity.

DETAILED DESCRIPTION OF EMBODIMENTS

In order to better explain the disclosure and facilitate understanding, the disclosure is detailed described through embodiments below, combined with accompanying drawings. It should be noted that the directional terms mentioned in this specification, such as "up", "down", "front", "back", "left", "right", etc., refer to the orientation in FIG. 1 and FIG. 7.

Embodiment 1

Figure 2:
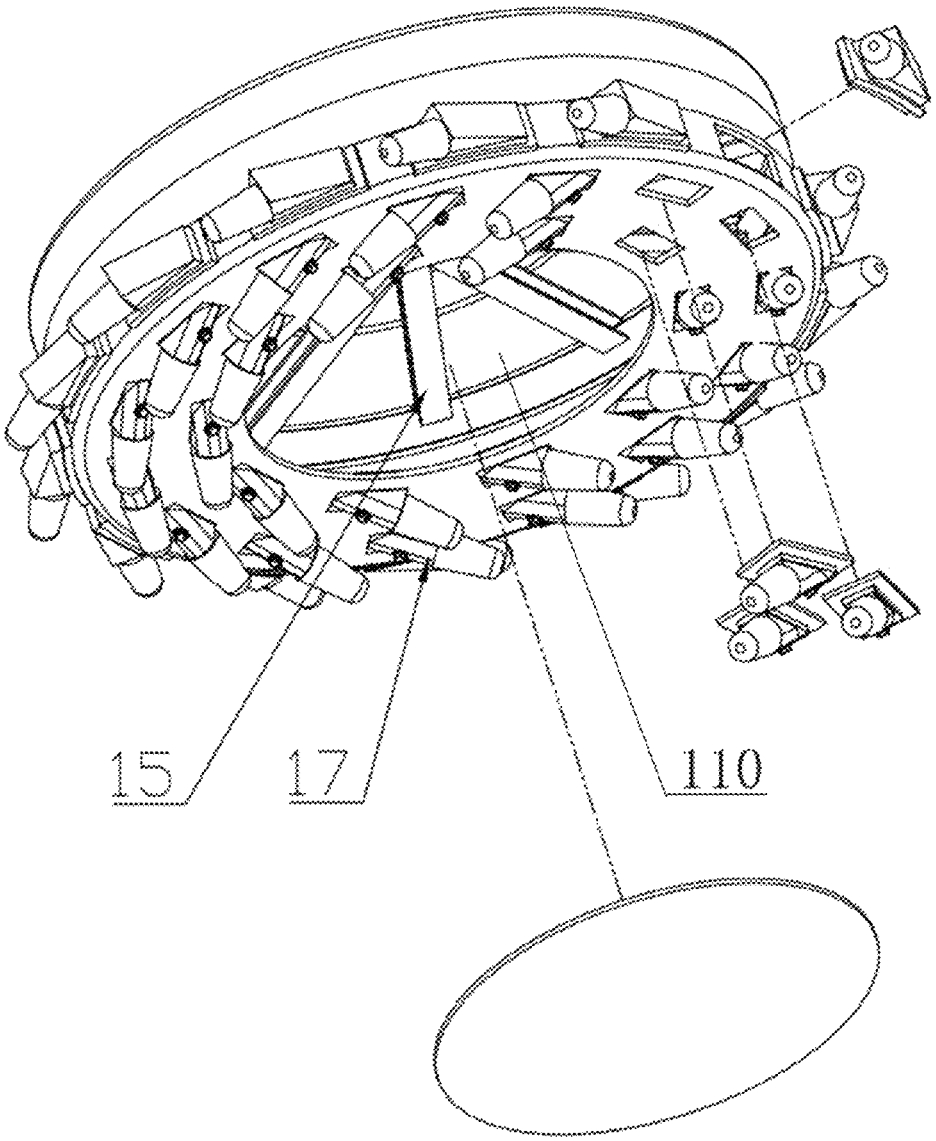
FIG. 2 illustrates a schematic exploded view of the road milling cutting disc according to the embodiment 1 of the disclosure.
Figure 3:
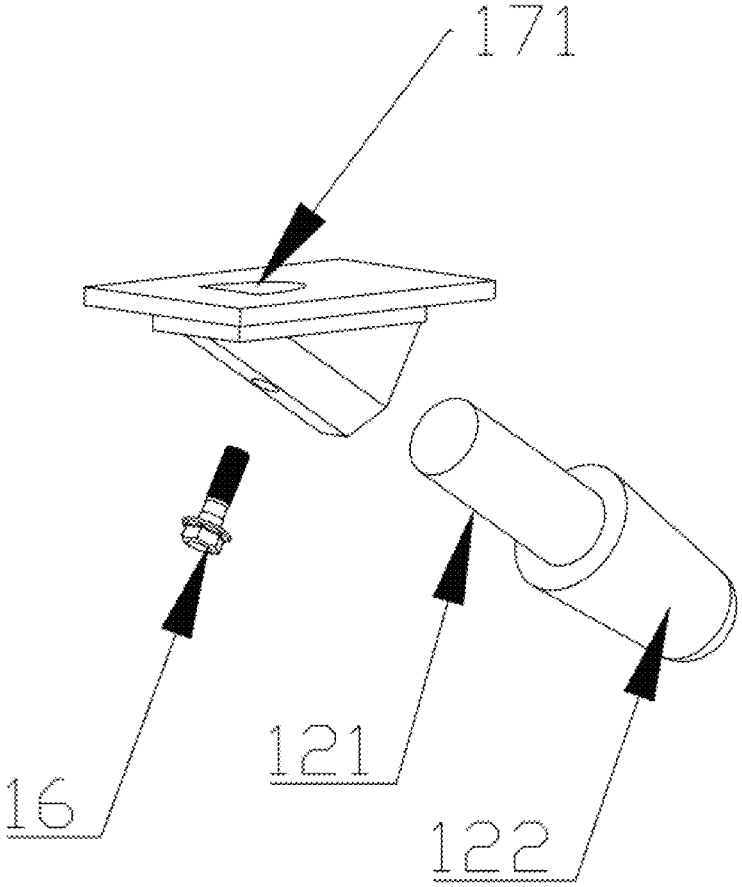
FIG. 3 illustrates a schematic diagram of an assembly structure of a cutting tooth installation position, an installation member and a cutting tooth according to the embodiment 1 of the disclosure.

Referring to FIG. 1 to FIG. 3, the disclosure provides a road milling cutting disc. The road milling cutting disc includes a support body 11 in a disc shape, the support body 11 includes a circumferential surface 18 and a bottom surface 19 which are arranged sequentially in that order from top to bottom, the bottom surface 19 is configured to be arranged facing toward a road surface, the circumferential surface 18 surrounds the bottom surface 19 and is connected to the bottom surface 19 along an edge of the bottom surface 19, the bottom surface 19 is provided with multiple first cutting teeth 12 around a rotational axis of the support body 11, and the circumferential surface 18 is provided with a plurality of second cutting teeth 13 around the rotational axis of the support body 11.

For the road milling cutting disc with above sets, the support body 11 is in the disc shape. The first cutting teeth 12 on the bottom surface 19 of the support body 11 may cut rocks in a horizontal direction, and the second cutting teeth 13 on the circumferential surface 18 may cut the rocks in a vertical direction, with high rock-breaking efficiency. After cutting protruding rocks, crushed rocks are easy to be dispersed and distributed, and can form a smoother road surface, which is conducive to vehicle driving.

Preferably, referring to FIG. 2, the support body 11 defines a cavity 110 therein, and thus the support body 11 is set as a hollow structure, a self-weight of the supporting body 11 is reduced, and it is convenient for the rotating drive and installation of the supporting body 11.

Preferably, a top of the support body 11 defines an opening 14 connected to the cavity 110, and a position of the support body 11 inside the cavity 110 corresponding to the opening 14 is provided with a rotating drive shaft installation position 15. Therefore, a rotating drive shaft can be inserted into the cavity 110 through the opening 14 and installed to the rotating drive shaft installation position 15. It is convenient for the road milling cutting disc to be connected to the rotate drive shaft, a whole structure of the road milling cutting disc is more stable and rotating cutting of the road milling cutting disc is more stable.

Preferably, the first cutting teeth 12 are arranged in a circular manner around the rotational axis of the support body 11 on the bottom surface 19, and the second cutting teeth 13 are arranged in a circular manner around the rotational axis of the support body 11 on the circumferential surface 18. Cutting teeth arranged in this way further improve the rock-breaking efficiency.

Preferably, each of the first cutting teeth 12 on the bottom surface 19 extends along a circular arrangement direction and is inclined downward, and each of the second cutting teeth 13 on the circumferential surface 18 extends along a circular arrangement direction and is inclined downward. In this way, the rock-breaking efficiency is high and when the road milling cutting disc is cutting the protruding rocks, and the crushed rocks are easily scattered around the road milling cutting disc, which is beneficial for forming a smooth road surface.

Furthermore, the first cutting teeth 12 are arranged around the rotational axis of the supporting body 11 on the bottom surface 19 to form at least two concentric circles, the second cutting teeth 13 are arranged around the rotational axis of the supporting body 11 on the circumferential surface 18 to form at least one circle sequentially arranged along an up-down direction. Furthermore, the at least two concentric circles are set closer to the edge of the bottom surface 19 compared to the rotational axis of the supporting body 11. In this way, a center of the bottom surface 19 may define an empty area to accommodate debris, reducing impact of the debris on the cutting teeth (i.e., the first cutting teeth 12 and the second cutting teeth 13).

Specifically, in the embodiment, the first cutting teeth 12 are arranged around the rotational axis of the supporting body 11 on the bottom surface 19 to form two concentric circles, and the second cutting teeth 13 are arranged around the rotational axis of the supporting body 11 on the circumferential surface 18 to form a circle close to the bottom surface 19.

Specifically, the cutting teeth are made of hard alloy material or diamond material. The cutting teeth made of above material have high hardness, toughness, and high efficiency in breaking rocks.

Preferably, a diameter of the road milling cutting disc is in a range of 100-400 centimeter (cm), a thickness (i.e., height) of the road milling cutting disc is in a range of 30-60 cm. The road milling cutting disc set with above size is beneficial for breaking and flattening the protruding rocks on the road surface. Preferably, the diameter of the road milling cutting disc is 400 cm, and the thickness of the road milling cutting disc is 50 cm. In this way, it is beneficial for breaking and flattening the protruding rocks on a road surface of a mine pit.

Preferably, the road milling cutting disc further includes multiple first installation members 16, and multiple second installation members, the bottom surface 19 is provided with multiple first cutting tooth installation positions 17 protruding from the bottom surface 19, the circumferential surface 18 is provided with multiple second cutting tooth installation positions protruding from the circumferential surface 18. Each first cutting tooth installation position 17 defines a first cutting tooth installation groove 171 extending along a respective first cutting tooth 12, each second cutting tooth installation position defines a second cutting tooth installation groove extending along a respective second cutting tooth 13. Each first cutting tooth 12 includes a first installation component 121 and a first cutting component 122, each first installation component 121 extends into a respective first cutting tooth installation groove 171, each first cutting component 122 extends out of the respective first cutting tooth installation groove 171 and is outside the support body 11, each first installation member 16 extends from an outside of the support body 11 into the respective first cutting tooth installation groove 171 and is detachably connected to a respective first installation component 121 to fix the respective first cutting tooth 12 to the support body 11 (as shown in FIG. 3). Each second cutting tooth 13 includes a second installation component and a second cutting component, each second installation component extends into a respective second cutting tooth installation groove, each second cutting component extends out of the respective second cutting tooth installation groove and is outside the support body 11, each second installation member extends from the outside of the support body 11 into the respective second cutting tooth installation groove and is detachably connected to a respective second installation component to fix the respective second cutting tooth 13 to the support body 11. By matching installation members and cutting tooth installation positions, it is convenient to fix the cutting teeth on the support body 11 and directly act on the installation members during maintenance and repair to achieve quick disassembly and assembly of the cutting teeth, as the cutting teeth are consumable parts.

Furthermore, the first installation members 16 are bolts, each first installation component 121 defines a threaded hole connected to one of the bolts respectively to achieve a detachable connection between each first installation component 121 and the respective first installation member 16. The second installation members are bolts, each second installation component defines a threaded hole connected to one of the bolts respectively to achieve a detachable connection between each second installation component and the respective second installation member.

In the embodiment, each first cutting component 122 is connected to the respective first installation component 121, each first cutting component 122 is in a conical shape, and each first installation component 121 is in a cylindrical shape. A cone bottom of each first cutting component 122 is connected to an end surface of the respective first installation component 121. Each second cutting component is connected to the respective second installation component, each second cutting component is in the conical shape, and each second installation component is in the cylindrical shape. A cone bottom of each second cutting component 122 is connected to an end surface of the respective second installation component.

Embodiment 2

Differences between the embodiment 1 and the embodiment 2 are below.

The first cutting teeth 12 are arranged in a spiral manner around the rotational axis of the support body 11 on the bottom surface 19, and the second cutting teeth 13 are arranged in a spiral manner around the rotational axis of the support body 11 on the circumferential surface 18. the cutting teeth arranged in this way further improve the rock-breaking efficiency.

Preferably, the first cutting teeth 12 are set closer to the edge of the bottom surface 19 compared to the rotational axis of the supporting body 11. In this way, the center of the bottom surface 19 may define the empty area to accommodate the debris, reducing the impact of the debris on the cutting teeth.

Preferably, each of the first cutting teeth 12 extends along a spiral arrangement direction and is inclined downward, and each of the second cutting teeth 13 extends along a spiral arrangement direction and is inclined downward. In this way, the rock-breaking efficiency is high and when the road milling cutting disc is cutting the protruding rocks, and the crushed rocks are easily scattered around the road milling cutting disc, which is beneficial for forming the smooth road surface.

Furthermore, a spiral arrangement path of the first cutting teeth 12 on the bottom surface 19 is connected to a spiral arrangement path of the second cutting tooth on the circumferential surface 18.

The rest content is the same as the embodiment 1 and is not be repeated here.

Embodiment 3

Differences between the embodiment 1 and the embodiment 3 are below.

The road milling cutting disc further includes the first installation members 16 and the second installation members, the bottom surface 19 defines multiple first cutting tooth installation holes connected to the cavity 110 and an outside of the support body 11, and the circumferential surface 18 defines multiple second cutting tooth installation holes connected to the cavity 110 and the outside of the support body 11. Each first cutting tooth 12 includes the first installation component 121 and the first cutting component 122. Each first installation component 121 extends into an inside of a corresponding first cutting tooth installation hole and each first cutting component 122 is outside the support body 11. Each first installation member 16 extends from the cavity 110 into the corresponding first cutting tooth installation hole and is detachably connected to the corresponding first installation component 121 to fix a corresponding first cutting tooth 12 to the support body 11. Each second cutting tooth 13 includes a second installation component and a second cutting component. Each second installation component extends into an inside of a corresponding second cutting tooth installation hole and each second cutting component is outside the support body 11. Each second installation member extends from the cavity 110 into the corresponding second cutting tooth installation hole and is detachably connected to the corresponding second installation component to fix a corresponding second cutting tooth 12 to the support body 11. In this way, it is convenient to fix the cutting teeth on the support body 11 and directly act on installation members by the opening 14 and the cavity 110 during the maintenance and the repair to achieve quick disassembly and assembly of the cutting teeth, as the cutting teeth are consumable parts.

The rest content is the same as the embodiment 1 and is not be repeated here.

Embodiment 4

Figure 4:
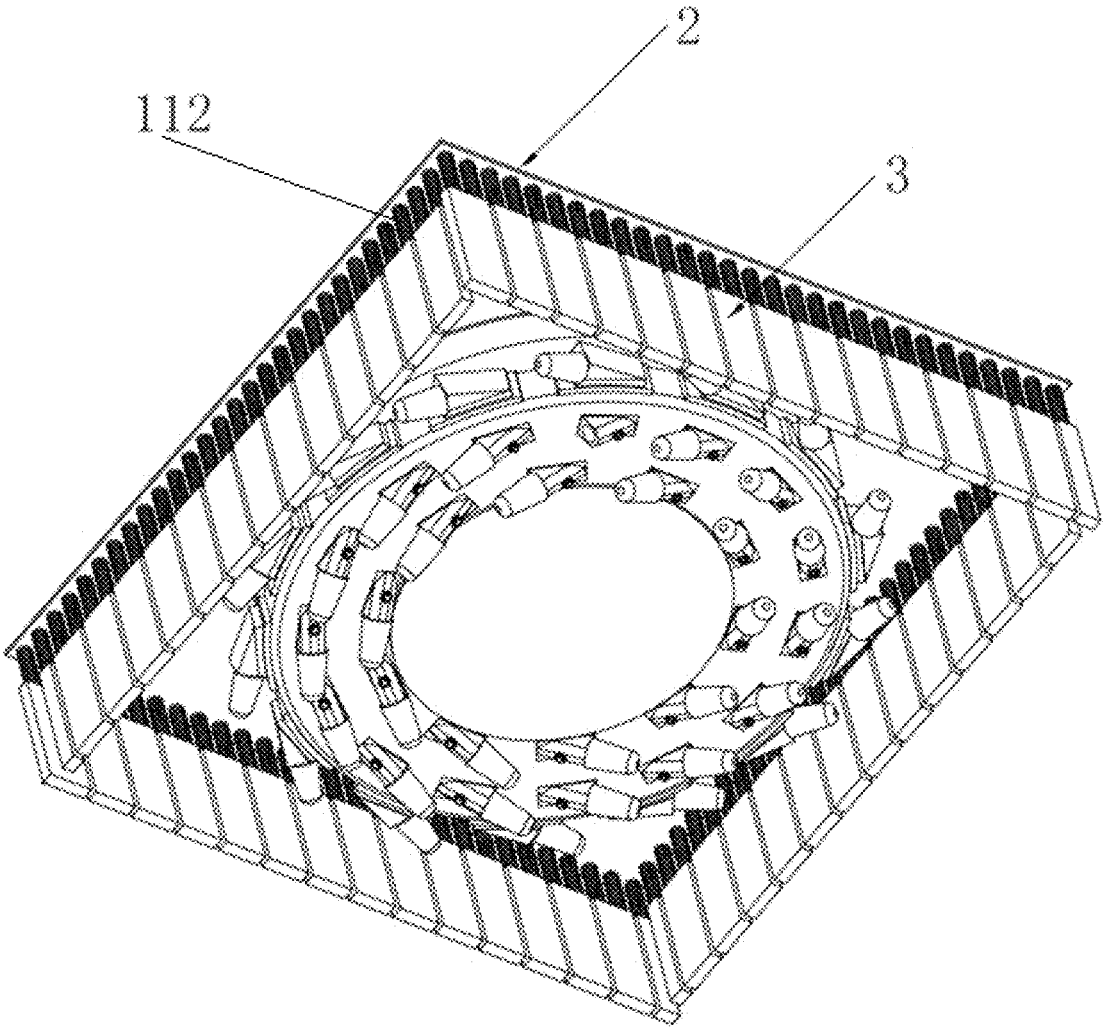
FIG. 4 illustrates a schematic three-dimensional structural diagram in a first-person perspective of a road milling device according to an embodiment 4 of the disclosure.
Figure 5:
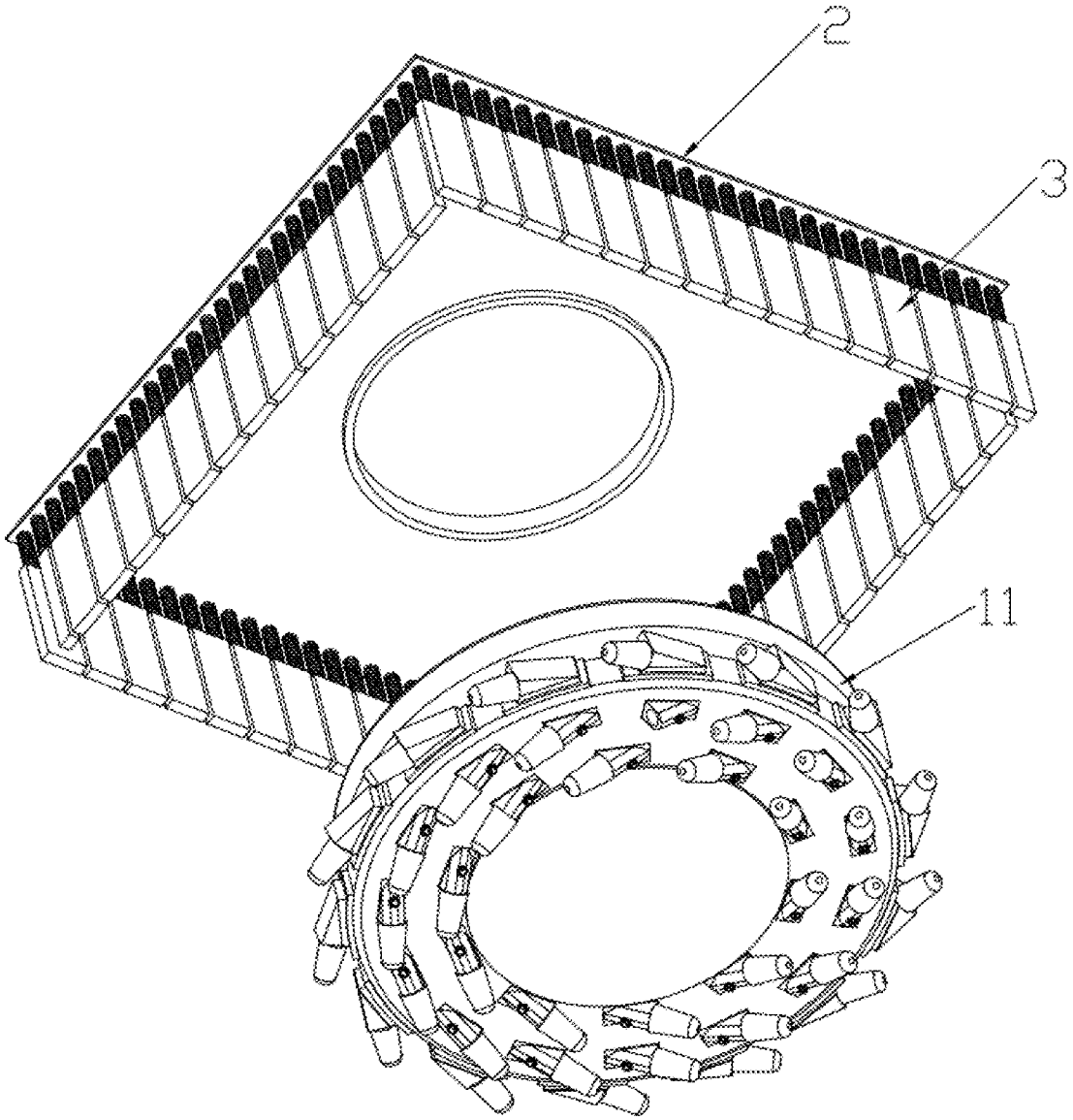
FIG. 5 illustrates a schematic exploded view of the road milling device according to the embodiment 4 of the disclosure.
Figure 6:
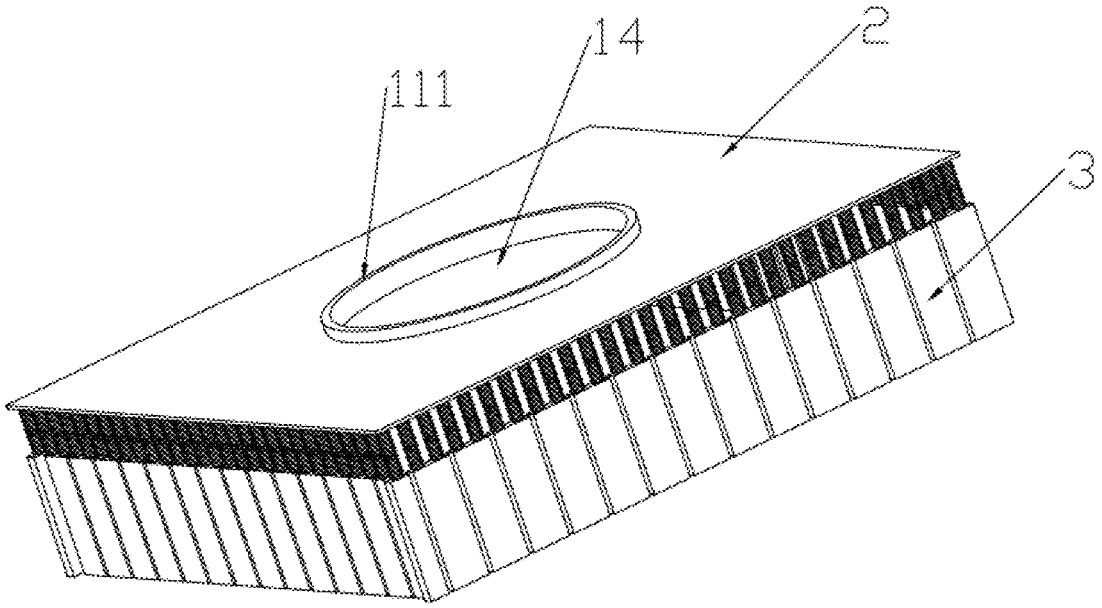
FIG. 6 illustrates a schematic three-dimensional structural diagram in a second-person perspective of the road milling device according to the embodiment 4 of the disclosure.

Referring to FIG. 4 to FIG. 6, the disclosure further provides a road milling device. The road milling device includes an installation board 2 and the road milling cutting disc in the embodiment 1 which are sequentially arranged in that order from top to bottom, the top of the support body 11 is rotatably installed on the installation board 2, a bottom surface of the installation board 2 is connected to multiple cover boards 3 arranged surrounding the road milling cutting disc, the cover boards 3 are arranged adjacent to each other, and the cover boards 3 are configured to be in contact with the road surface during a process of cutting the road surface by the road milling cutting disc.

For the road milling device arranged above, when the road milling cutting disc is rotating to cut the rocks, the debris splashed out can be blocked within the cover boards 3, avoiding damage caused by the debris splashed out.

Preferably, each cover board 3 is connected to the installation board 2 by springs 112. In this way, during a movement process of the road milling device following a vehicle, the cover boards 3 can rise and fall under an action of the springs 112 when in contact with an uneven road surface, ensuring that the cover boards 3 always maintain contact with the road surface without affecting the movement of the vehicle.

Preferably, the cover boards 3 are made of flexible material. In this way, during the movement process of the road milling device following a vehicle, the flexible cover boards 3 can bend and deform when in contact with the uneven road surface, further ensuring that the cover boards 3 always maintain contact with the road surface, blocking cutting debris while not affecting the vehicle movement. When the cutting debris collides with the cover boards 3, the cover boards 3 made of the flexible material can better absorb energy of the debris. Furthermore, the cover boards 3 are made of rubber material. In this way, the cutting debris hitting the cover boards 3 will not make a loud noise.

Preferably, a width of each cover board 3 is in a range of 20-50 cm, a height of each cover board 3 is in a range of 50-100 cm, and a thickness of each cover board 3 is in a range of 2-5 cm.

In the embodiment, the cover boards 3 form a square around the road milling cutting disc, a size of each of the cover boards 3 is slightly greater than the diameter of the road milling cutting disc, for example, the diameter of the road milling cutting disc is 2.2 meter (m), then the size of each of the cover boards 3 is 2.4 m×2.4 m.

Preferably, as shown in FIG. 6, the installation board 2 defines an installation port corresponding to the opening 14 of the support body 11. The top of the support body 11 is provided with a flange 111 surrounding the opening 14. The flange 111 is rotatably connected to the installation board 2. In this way, it is convenient for the rotating drive shaft to connect the road milling cutting disc by the installation port. The flange 111 is rotatably connected to the installation board 2 to prevent the opening 14 from being exposed to a cutting area (i.e., an area surrounded by the installation board 2 and the cover boards 3) of the road milling cutting disc, and further to prevent the debris from entering the support body 11 through the opening 14 and affecting normal operations of the road milling cutting disc.

Embodiment 5

Figure 7:
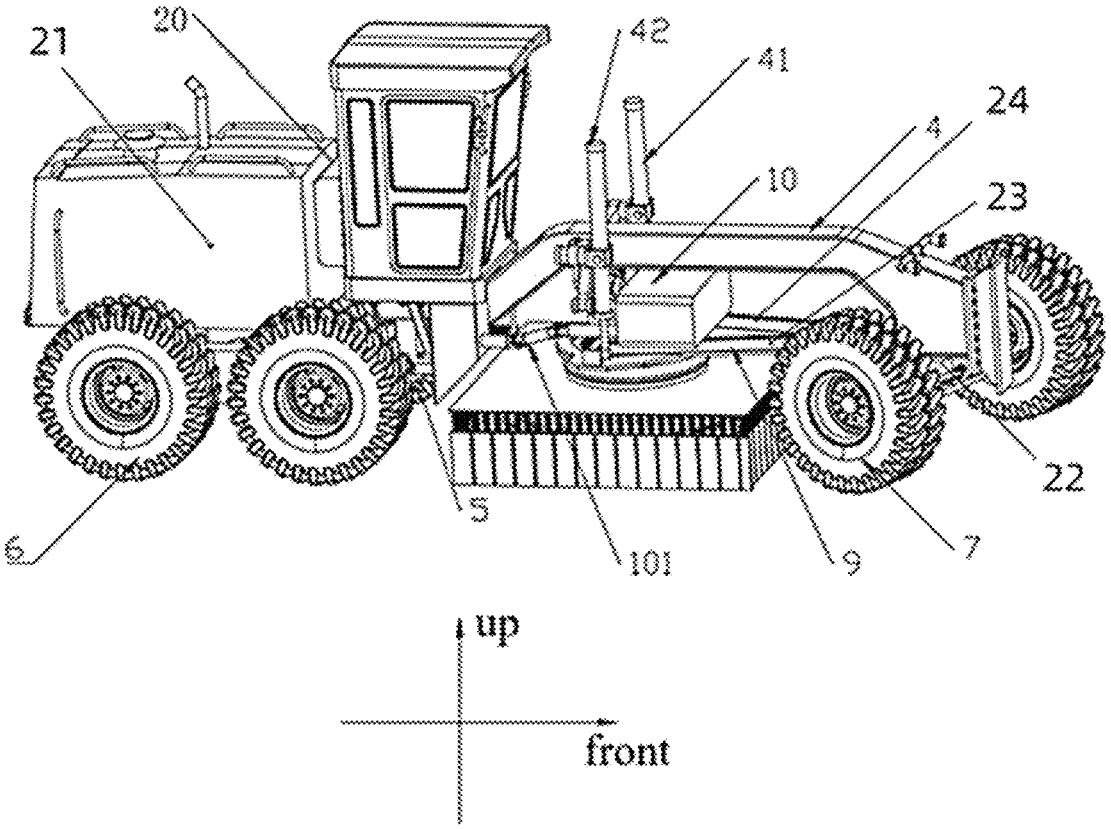
FIG. 7 illustrates a schematic three-dimensional structural diagram in a first-person perspective of a road planing machine according to an embodiment 5 of the disclosure.
Figure 8:
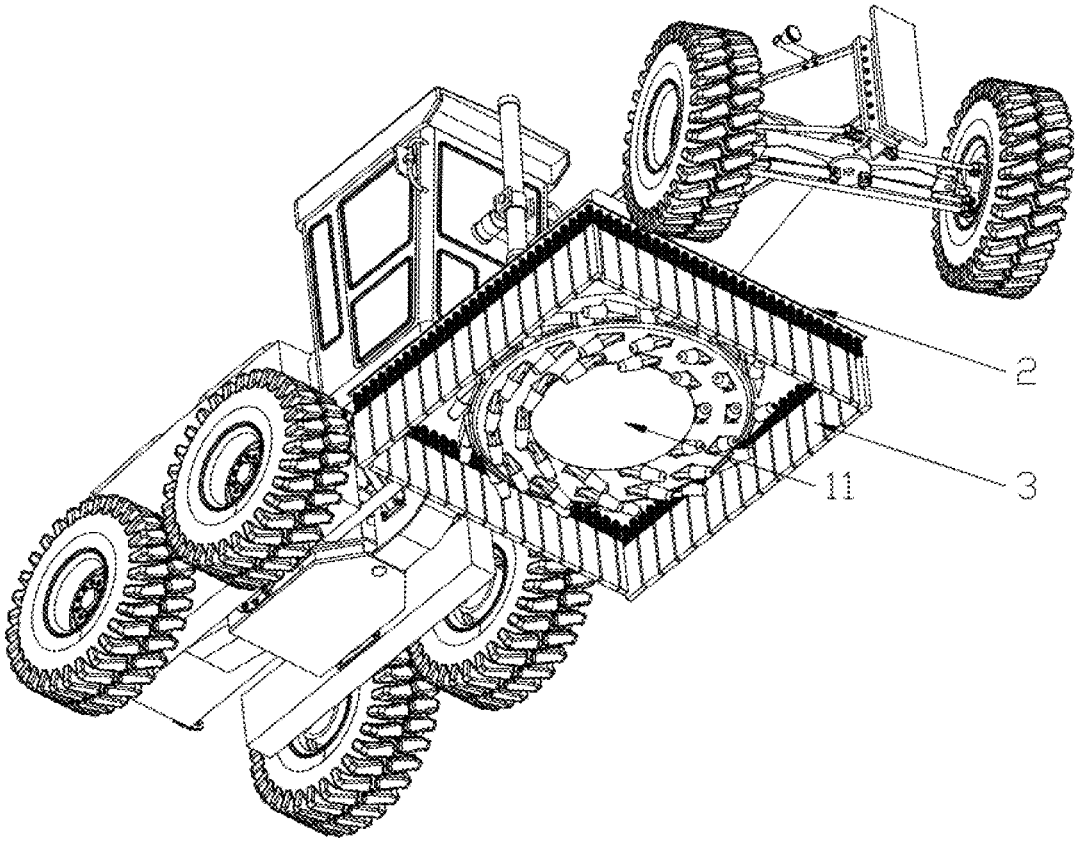
FIG. 8 illustrates a schematic three-dimensional structural diagram in a second-person perspective of the road planing machine according to the embodiment 5 of the disclosure.

Referring to FIG. 7 and FIG. 8, the disclosure provides a road planing machine. The road planing machine includes a vehicle body 20 and the road milling device in the embodiment 4, the road milling device is suspended on the vehicle body 20 and configured to be in contact with and engaged with the road surface, and the vehicle body 20 is configured to drive the road milling device to work. The road planing machine or the road milling device can be installed with one road milling cutting disc or multiple road milling cutting discs to achieve purposes of faster and better cutting protruding hard objects on the road (or ground) surface.

A frame of the vehicle body 20 includes a front frame 4 and a rear frame 5 which are sequentially hinged from front to rear, and the front frame 4 is hinged to the rear frame 5 by a hinge joint. The hinge joint enables the front frame 4 to pivot, for example, relative to the rear frame 5, to assist in turning the road planing machine when changing a movement direction of the road planing machine, or to be used to perform special or unique tasks, such as operating the road planing machine in a "yaw" configuration where the rear frame 5 and the front frame 4 are not in a straight line with each other.

To ensure the road planing machine move or travel relative to the road surface, the rear frame 5 is supported on drive wheels 6, the front frame 4 is supported on steering wheels 7, and the steering wheels 7 are configured to make the road planing machine turn or steer.

In order to rotate the drive wheels 6, the road planing machine includes an engine 21 accommodated on the rear frame 5, the engine 21 is connected to the drive wheels 6 by a power transmission system. The power transmission system includes a transmission or other components used to assist and regulate machine power transmission. The engine 21 can be any suitable type of engines, including, for example, a diesel engine, a spark ignition gasoline engine, a natural gas engine, or any other engine known in the art. In addition to providing power for the drive wheels 6, the engine 21 is operably associated with a hydraulic system, and the hydraulic system can supply pressurized hydraulic fluid to various hydraulic actuators and components set around the road planing machine, helping with operations and operability of the road planing machine.

To accommodate an operator of the road planing machine, a cab is installed on the rear frame 5.

The road planing machine further includes a pull rod 9 arranged below the front frame 4, the pull rod 9 can be an A-shaped frame truss structure connected to a front end of the front frame 4 by a multi-dimensional universal joint 22 (such as a ball joint). The pull rod 9 extends roughly backwards from the multi-dimensional universal joint 22 to a front side of the cab and can be roughly horizontally supported above the road surface. The road milling device is installed on the A-shaped frame truss structure and is located below the A-shaped frame truss structure. Specifically, the installation board 2 of the road milling device is installed on the A-shaped frame truss structure.

In order to raise and lower the road milling device relative to the road surface, the road planing machine includes hydraulic linear actuator that are extendable and retractable, such as a first lifting cylinder 41 and a second lifting cylinder 42. The first lifting cylinder 41 is arranged at a left side of the front frame 4, an end of the first lifting cylinder 41 is connected to the front frame 4, and another end of the first lifting cylinder 41 is connected to the A-shaped frame truss structure. The second lifting cylinder 42 is arranged at a right side of the front frame 4, an end of the second lifting cylinder 42 is connected to the front frame 4, and another end of the second lifting cylinder 42 is connected to the A-shaped frame truss structure.

In this way, simultaneously extending or retracting the first lifting cylinder 41 and the second lifting cylinder 42 can raise or lower a height of the road milling device. Independently extending or retracting the first lifting cylinder 41 and the second lifting cylinder 42 can adjust a cutting slope of the road milling device.

Preferably, the road planing machine includes a rotating drive assembly 10, the rotating drive assembly 10 is installed on the A-shaped frame truss structure or the installation board 2, and the rotating drive assembly 10 is in transmission connection with the road milling cutting disc.

It should be noted that, the rotating drive assembly 10 is in transmission connection with the road milling cutting disc. The rotating drive assembly 10 can adjust a rotating speed of the road milling cutting disc when driving the road milling cutting disc. Specifically, the rotating speed of the road milling cutting disc can be adjusted in a range of 10 revolutions per minute (rpm) –2000 rpm.

Preferably, the engine 21 can be operably connected to the rotating drive assembly 10 for transmission. Specifically, the engine 21 is respectively connected to the drive wheels 6 and the rotating drive assembly 10 through the transmission and a transfer case sequentially. Furthermore, the transfer case is in transmission connection with the rotating drive assembly 10 through a universal joint 101. Optionally, the engine 21 is in transmission connection with the drive wheels 6 and rotating drive assembly 10 through the transmission.

In addition to the above-mentioned driving methods, the rotating drive assembly 10 can be: a. an electric motor, power emitted by the engine 21 drives a generator to operate, converting kinetic energy into electrical energy, the electrical energy is transmitted to the electric motor, and the electric motor drives the road milling cutting disc to rotate; b. a hydraulic motor, the power of the engine 21 drives a hydraulic pump, then the hydraulic pump provides high-pressure liquid to flow to the hydraulic motor, driving the hydraulic motor to rotate, and then driving the road milling cutting disc to rotate; c. an air motor, the power of the engine 21 drives an air pump, then the air pump provides high-pressure air to flow to the air compressor motor, driving the air motor to rotate, and thereby driving the road milling cutting disc to rotate; d. an electric motor, which is driven not by a traditional engine 21, but by a battery pack, the battery pack serves as a power source for the entire road planing machine, a part of the power of the battery pack is used to drive the drive wheels 6, while another part of the power of the battery pack is used to drive the electric motor to rotate, thereby driving the road milling cutting disc to rotate, and achieve the purpose of cutting hard objects such as the protruding rocks on the road surface.

Embodiment 6

A cutting disc of the road planing machine can be in various forms to meet needs of different road geological conditions. In addition to the road milling cutting disc in the embodiment 1-5, the cutting disc can be a spoked and webbed cutting disc to reduce a self-weight of the cutting disc, as shown in FIG. 9 and FIG. 10

Figure 9:
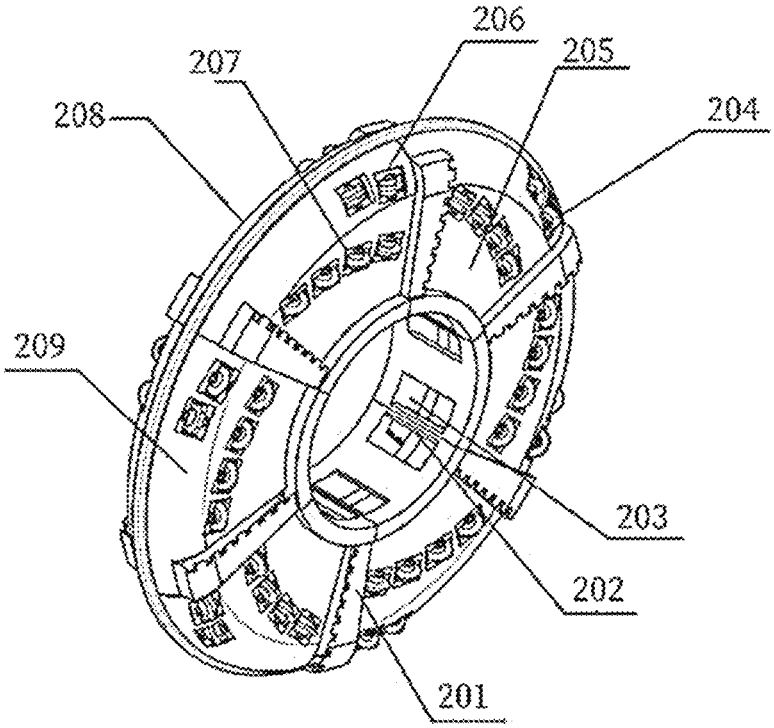
FIG. 9 illustrates a schematic diagram of a spoked and webbed cutting disc according to an embodiment 6 of the disclosure.

A spoked and webbed cutting disc shown in FIG. 9 includes multiple spokes 201, periphery cutting teeth 204, webs 205, side cutting teeth 206, bottom cutting teeth 207, a periphery surface 208 and a cutting disc body 209. The spoked and webbed cutting disc in FIG. 9 defines a cavity 202 at a center of the spoked and webbed cutting disc in FIG. 9, and defines installation holes 203 configured to install cutting teeth in a vertical direction.

Figure 10:
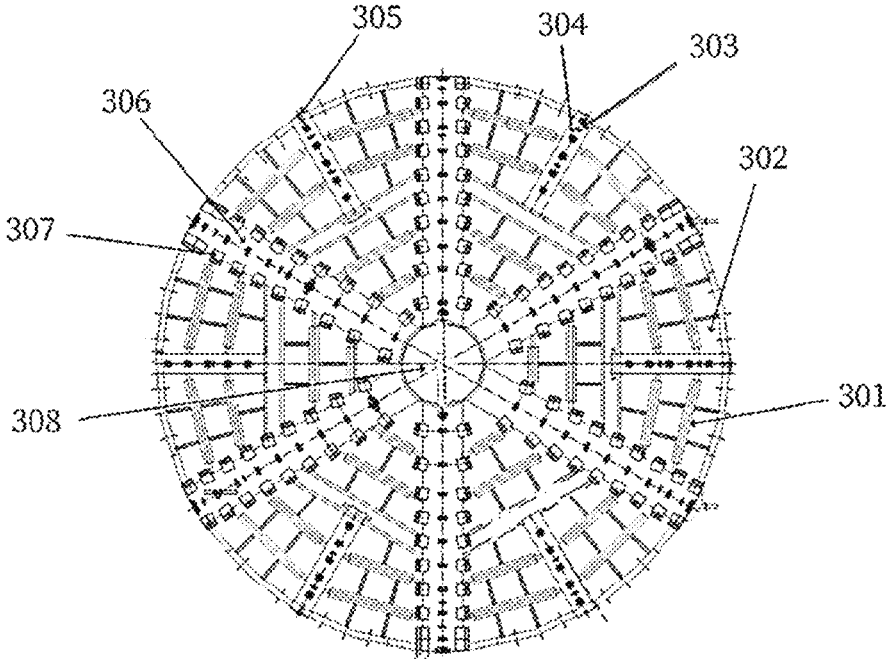
FIG. 10 illustrates a schematic diagram of another spoked and webbed cutting disc according to the embodiment 6 of the disclosure.

A spoked and webbed cutting disc shown in FIG. 10 includes transverse webs 301, large transverse cutting teeth 303, small transverse cutting teeth 304, cutting tooth disc periphery 305, longitudinal webs 306 and longitudinal cutting teeth 307. The spoked and webbed cutting disc in FIG. 10 defines gaps 302 and a cavity 308 (i.e., an installation hole), and the cavity 308 is at a center of the spoked and webbed cutting disc in FIG. 10.

In the disclosure, it should be understood that terms "first" and "second" are only used for descriptive purposes and cannot be understood as indicating or implying relative importance or implying the quantity of technical features indicated. Therefore, features limited to "first" and "second" can explicitly or implicitly include one or more of the features. In the description of the disclosure, "multiple" means two or more, unless otherwise specified.

In the disclosure, unless otherwise specified and limited, terms, such as "installation", "connection", "connected", and "fixed" etc., should be broadly understood, for example, it can be a fixed connection, a detachable connection, or integrated; it can be a mechanical connection or an electrical connection; it can be a direct connection or an indirect connection through an intermediate medium; it can be an internal connection of two components or an interaction relationship between two components. For those skilled in the art, specific meanings of the above terms in the disclosure can be understood based on specific circumstances.

In the disclosure, unless otherwise specified and limited, a first feature is "above" or "below" a second feature, which can direct contact between the first feature and the second feature, or indirect contact between the first feature and the second feature through an intermediate medium. Moreover, if the first feature is "above", "on", and "at a top of" the second feature, it can be understood as that the first feature is directly or diagonally above the second feature, or simply indicates that the first feature is horizontally higher than the second feature. The first feature is "below", "underside", and "at a bottom of" the second feature, which can mean that the first feature is directly or diagonally below the second feature, or simply indicating that a horizontal height of the first feature is lower than that of the second feature.

In the description of this specification, terms "one embodiment," "some embodiments," "embodiment," "examples," "specific examples," or "some examples," etc. refer to the specific features, structures, materials, or characteristics described in conjunction with the embodiments or examples included in at least one embodiment or example of the disclosure. In this specification, illustrative expressions of the above terms do not necessarily refer to the same embodiments or examples. Moreover, the specific features, structures, materials, or characteristics described can be combined in an appropriate manner in any one or more embodiments or examples. In addition, those skilled in the art may combine and composite the different embodiments or examples described in this specification, as well as the features of different embodiments or examples, without conflicting with each other.

Although the embodiments of the disclosure have been shown and described above, it can be understood that the above embodiments are exemplary and cannot be understood as limitations to the disclosure. Those skilled in the art may change, modify, replace, and transform the above embodiments within the scope of the disclosure.

What is claimed is:

1. A road planing machine, comprising: a vehicle body (20), drive wheels (6), an installation board (2), a plurality of cover boards (3), a battery pack, a rotating drive assembly (10) being an electric motor, and a road milling cutting disc;

wherein the battery pack serves as an entire power source for the road planing machine, a part of power of the battery pack is configured to drive the drive wheels (6), and another part of power of the battery pack is configured to drive the electric motor to rotate and thereby drive the road milling cutting disc to rotate;

wherein the electric motor is in transmission connection with the road milling cutting disc and configured to drive the road milling cutting disc to rotate, and the road milling cutting disc is suspended on the vehicle body (20) and configured to be in contact with and engaged with a road surface;

wherein the road milling cutting disc comprises a support body (11) in a disc shape, the support body (11) comprises a circumferential surface (18) and a bottom surface (19) which are arranged sequentially in that order from top to bottom, the bottom surface (19) is configured to be arranged facing toward the road surface, the circumferential surface (18) surrounds the bottom surface (19) and is connected to the bottom surface (19) along an edge of the bottom surface (19), the bottom surface (19) is provided with a plurality of first cutting teeth (12) around a rotational axis of the support body (11), and the circumferential surface (18) is provided with a plurality of second cutting teeth (13) around the rotational axis of the support body (11); and wherein a top of the support body (11) is rotatably installed on the installation board (2), a bottom surface of the installation board (2) is connected to the plurality of cover boards (3) arranged surrounding the road milling cutting disc, the plurality of cover boards (3) are arranged adjacent to each other, and the plurality of cover boards (3) are configured to be in contact with the road surface during a process of cutting the road surface by the road milling cutting disc.

2. The road planing machine as claimed in claim 1, wherein a diameter of the road milling cutting disc is 400 centimeters (cm), and a height of the road milling cutting disc is 50 cm.

3. The road planing machine as claimed in claim 1, wherein the support body (11) defines a cavity (110) therein and thereby the support body (11) is set as a hollow structure; and wherein the top of the support body (11) defines an opening (14) connected to the cavity (110), a position of the support body (11) inside the cavity (110) corresponding to the opening (14) is provided with a rotating drive shaft installation position (15), the top of the support body (11) is provided with a flange (111) surrounding the opening (14), and the flange (111) is configured to prevent debris from entering the support body (11) through the opening (14) and affecting normal operations of the road milling cutting disc.

4. A road planing machine, comprising: a vehicle body (20), a rotating drive assembly (10) being an electric motor, and a road milling cutting disc;

wherein the electric motor is in transmission connection with the road milling cutting disc and configured to drive the road milling cutting disc to rotate, and the road milling cutting disc is suspended on the vehicle body (20) and configured to be in contact with and engaged with a road surface;

wherein the road milling cutting disc comprises a support body (11) in a disc shape, the support body (11) comprises a circumferential surface (18) and a bottom surface (19) which are arranged sequentially in that order from top to bottom, the bottom surface (19) is configured to be arranged facing toward the road surface, the circumferential surface (18) surrounds the bottom surface (19) and is connected to the bottom surface (19) along an edge of the bottom surface (19), the bottom surface (19) is provided with a plurality of first cutting teeth (12) around a rotational axis of the support body (11), and the circumferential surface (18) is provided with a plurality of second cutting teeth (13) around the rotational axis of the support body (11).

5. The road planing machine as claimed in claim 4, wherein a diameter of the road milling cutting disc is in a range of 100-400 cm, and a height of the road milling cutting disc is in a range of 30-60 cm.

6. The road planing machine as claimed in claim 4, wherein the support body (11) defines a cavity (110) therein and thereby the support body (11) is set as a hollow structure.

7. The road planing machine as claimed in claim 4, wherein a top of the support body (11) defines an opening (14) connected to the cavity (110), a position of the support body (11) inside the cavity (110) corresponding to the opening (14) is provided with a rotating drive shaft installation position (15), the top of the support body (11) is provided with a flange (111) surrounding the opening (14), and the flange (111) is configured to prevent debris from entering the support body (11) through the opening (14) and affecting normal operations of the road milling cutting disc.

8. The road planing machine as claimed in claim 4, wherein the plurality of first cutting teeth (12) are arranged in a circular manner around the rotational axis of the support body (11) on the bottom surface (19), and the plurality of second cutting teeth (13) are arranged in a circular manner around the rotational axis of the support body (11) on the circumferential surface (18); or wherein the plurality of first cutting teeth (12) are arranged in a spiral manner around the rotational axis of the support body (11) on the bottom surface (19), and the plurality of second cutting teeth (13) are in a spiral manner around the rotational axis of the support body (11) on the circumferential surface (18).

9. The road planing machine as claimed in claim 4, wherein the plurality of first cutting teeth (12) are detachably connected to the support body (11) and the plurality of second cutting teeth (13) are detachably connected to the support body (11).

10. The road planing machine as claimed in claim 9, wherein the road milling cutting disc further comprises:

a plurality of cutting tooth installation positions (17), wherein each of the plurality of cutting tooth installation positions (17) protrudes from the bottom surface (19) and defines a cutting tooth installation groove (171); and a plurality of installation members (16);

wherein each of the plurality of first cutting teeth (12) comprises an installation component (121) and a cutting component (122) which are connected to each other, each of the plurality of installation members (16) extends from an outside of the support body (11) into the cutting tooth installation groove (171) and is detachably connected to the installation component (121), and the cutting component (122) extends out of the cutting tooth installation groove (171) and is outside the support body (11).

11. The road planing machine as claimed in claim 7, further comprising: an installation board (2); wherein the top of the support body (11) is rotatably installed on the installation board (2), a bottom surface of the installation board (2) is connected to a plurality of cover boards (3) arranged surrounding the road milling cutting disc, the plurality of cover boards (3) are arranged adjacent to each other, and the plurality of cover boards (3) are configured to be in contact with the road surface during a process of cutting the road surface by the road milling cutting disc.

12. The road planing machine as claimed in claim 11, wherein the plurality of cover boards (3) are connected to the installation board (2) by springs (112).

13. The road planing machine as claimed in claim 11, wherein the plurality of cover boards (3) are made of a flexible material.

14. The road planing machine as claimed in claim 11, wherein a width of each of the plurality of cover boards (3) is in a range of 20-50 cm, a height of each of the plurality of cover boards (3) is in a range of 50-100 cm, and a thickness of each of the plurality of cover boards (3) is in a range of 2-5 cm.

* * * * *